US007213577B2

(12) United States Patent
Hummel et al.

(10) Patent No.: US 7,213,577 B2
(45) Date of Patent: May 8, 2007

(54) METHOD FOR PRODUCING A FUEL ACCUMULATOR LINE COMPRISING A PRESTRESSED CONNECTION PIECE

(75) Inventors: Helmut Hummel, Hohenburg (DE); Georg Weigl, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/840,565

(22) Filed: May 6, 2004

(65) Prior Publication Data

US 2004/0206336 A1 Oct. 21, 2004

Related U.S. Application Data

(63) Continuation of application No. PCT/DE02/04114, filed on Nov. 6, 2002.

(30) Foreign Application Priority Data

Nov. 7, 2001 (DE) ..... 101 54 645

(51) Int. Cl.
*F02M 55/02* (2006.01)

(52) U.S. Cl. ..... 123/469; 123/468; 285/133.11; 285/290.5; 138/DIG. 5

(58) Field of Classification Search ..... 123/468, 123/469, 470, 456; 138/153, 89, DIG. 5; 285/133.4, 197, 288.1, 382, 133.11, 290.5; 29/890.148

See application file for complete search history.

(56) References Cited

U.S. PATENT DOCUMENTS 6,062,263 A * 5/2000 Donovan et al. ..... 138/89
6,126,208 A * 10/2000 Asada et al. ..... 285/133.4
6,325,108 B1 * 12/2001 Bettinger ..... 138/153
6,408,826 B2 * 6/2002 Asada et al. ..... 123/468
6,470,856 B1 * 10/2002 Boecking ..... 123/456
6,520,155 B1 * 2/2003 Boecking ..... 123/456
6,609,502 B1 * 8/2003 Frank ..... 123/469

FOREIGN PATENT DOCUMENTS

| | | |
|---|---|---|
| DE | 3817413 A1 | 5/1988 |
| DE | 40 30 484 A1 | 9/1990 |
| DE | 198 08 807 A1 | 3/1998 |
| EP | 0 508 362 A2 | 4/1992 |
| JP | 2001221126 A | 8/2001 |

OTHER PUBLICATIONS

PCT Communication of the International Preliminary Test Report Application No. PCT/DE02/04114, 8 pages (German).
PCT International Search Report Application No. PCT/DE02/04114, 6 pages (English).

* cited by examiner

*Primary Examiner*—Carl S. Miller
(74) *Attorney, Agent, or Firm*—Baker Botts L.L.P.

(57) ABSTRACT

The invention relates to a method for producing a fuel accumulator line and a fuel accumulator line comprising prestressed connection pieces. The connection pieces are mounted onto the fuel accumulator line with a prestress, by crimping, or by a temporal expansion and/or a temporal contraction of the fuel accumulator line. The connection pieces connect a line to the fuel accumulator line. The prestressing of the connection pieces allows pressure to be exerted on the fuel accumulator line, thus increasing the compressive strength.

9 Claims, 2 Drawing Sheets

METHOD FOR PRODUCING A FUEL ACCUMULATOR LINE COMPRISING A PRESTRESSED CONNECTION PIECE

CROSS-REFERENCE TO RELATED APPLICATION

This application is a continuation of international application no. PCT/DE02/04114 filed Nov. 6, 2002 which designates the United States, and claims priority to German application number DE10154645.9 filed Nov. 7, 2001.

TECHNICAL FIELD

The invention relates to a method for producing a fuel accumulator line for an internal-combustion engine, and an improved fuel accumulator line.

BACKGROUND OF THE INVENTION

Fuel accumulator lines are used in the range of automotive engineering to set up a common rail injection system. The fuel accumulator line is then used as a storage volume in which a fuel at a relatively high pressure can be kept ready. The fuel is released into the combustion chamber of the internal-combustion engine via injection valves allocated to the fuel accumulator line. The fuel accumulator line is used for direct fuel injection in both petrol and diesel internal-combustion engines.

For a precise and efficient injection, a very high pressure in the fuel accumulator line is desirable, particularly in the case of diesel fuel injection. In the meantime, pressures of 1500 to 2000 bar are reached. This pressure range in particular makes very high quality demands on the fuel accumulator line. Particularly, the connection of a line to the fuel accumulator line is a critical function that has a great influence on the quality of the fuel accumulator line. In order to connect a line, a hole in the wall of the fuel accumulator line is required. A wall with a hole has the disadvantage that cracks form in the area of the hole which subsequently ruptures under high pressures. In addition, it is necessary to press the line under high pressure against the fuel accumulator line to form a seal against the high pressures.

In order to connect a line to the fuel accumulator line it is well-known from DE 3 817 413 Al to arrange, for example, a circular connecting piece in the area of a connection bore of the fuel accumulating line. The connecting piece includes the fuel accumulator line in the area of the connection bore and has a thread. The thread is used for screwing in a retaining nut by means of which a line to be connected to the fuel accumulator line is prestressed in the direction of the fuel accumulator line. Because the connecting piece includes the fuel accumulator line, the line can be prestressed against the fuel accumulator line with a relatively high force. For purposes of better fastening, the connecting piece must be connected to the fuel accumulator line via a welding seam.

SUMMARY OF THE INVENTION

The object of the invention is to provide an improved method for producing a fuel accumulator line and an improved fuel accumulator line.

An object of the invention is achieved by a method comprising the steps of: making at least one hole in the wall of the fuel accumulator line in a connecting area, and mounting a connecting piece onto the connecting area with prestress, wherein the inside diameter of the connecting piece is less than the outside diameter of the connecting area, and the connecting piece is mounted onto the connecting area via a lateral pressing-on process.

An object of the invention is achieved by a fuel accumulator line assembly comprising a fuel accumulator line having a connecting area including a connecting opening, and a connecting piece for connecting a line, said connecting piece adapted for the connecting area of the fuel accumulator line, wherein the connecting piece has a prestress in the direction of the fuel accumulator line and comprises at least two connecting areas partially having different outside diameters.

An object of the invention is achieved by a fuel accumulator line assembly comprising a fuel accumulator line having a connecting area including a connecting opening, and a connecting piece for connecting a line to the connecting area, wherein the connecting piece has a prestress in the direction of the fuel accumulator line.

An advantage of the invention is the fact that the connecting piece is mounted onto the fuel accumulator line. As a result, a frictional connection is produced with a simple method between the connecting piece and the fuel accumulator line. Therefore, the position of the connecting piece is specified with reference to the fuel accumulator line. Prestressing the connecting piece also has the advantage that prestressing acts on the fuel accumulator line thus, increasing the high compressive strength of the fuel accumulator line. Particularly, in a connecting area in which a hole is made in the fuel accumulator line, prestressing is positive because the material structure of the fuel accumulator line is kept in a more stable area by prestressing in the area of the connecting piece.

In a further advantageous development of the method, the hole in the fuel accumulator line is only made after the connecting piece has been mounted. Therefore, the connecting piece can already have an opening in the area of the hole to be made. However, it is also possible to first make an opening in the mounted connecting piece. In this way, an improved procedure is provided when making the hole in the fuel accumulator line. Prestressing onto the fuel accumulator line from the outside acts positively compared to the formation of dislocations or cracks when a hole is made in the fuel accumulator line.

In simple embodiments of the method according to the invention, the connecting piece is mounted onto the fuel accumulator line by a temporal expansion of the inside diameter of the connecting piece or by a temporal contraction of the outside diameter of the fuel accumulator line. The expansion of the connecting piece and/or the contraction of the outside diameter of the fuel accumulator line provides simple and current methods by means of which a connecting piece can be mounted onto the fuel accumulator line by prestressing. For this, the connecting piece has a smaller inside diameter under normal ambient conditions compared to the outside diameter of the fuel accumulator line. After mounting, the inside diameter of the connecting piece and/or the outside diameter of the fuel accumulator line again takes on the original size so that the connecting piece exerts a radial prestress force on the wall of the fuel accumulator line directed towards the center of the fuel accumulator line. Therefore, the prestress force is collectively distributed equally across the length of the fuel accumulator line.

In a preferred embodiment, a fuel accumulator line is used that has at least two connecting areas whose outside diameters have different sizes. In this way, a first connecting piece with a bigger inside diameter can from the one side of a first connecting piece be slid over an outside connecting area with a smaller outside diameter. Only then will the first connecting piece be slid over the second connecting area by means of a lateral pressing-on process. For the second connecting area, a second connecting piece is provided that has a smaller inside diameter compared to the first connecting piece and is also slid over the second connecting area via a lateral pressing-on process. In this way it is possible to slide a connecting piece via the one connecting area onto a further connecting area without using a contraction or expansion process and only in the case of a further connecting area is the connecting piece mounted onto the fuel accumulator line with a prestress by crimping.

In a further embodiment, a connecting area is implemented by compressing the fuel accumulator line. Compression increases the outside diameter of the fuel accumulator line. The compression offers additional advantages for the strength of the fuel accumulator line in the vicinity of the connecting area. For example, the fuel accumulator line can be a single pipe with a hollow space made by a longitudinal bore. Subsequently, by compressing the fuel accumulator line in the specified connecting areas, the outside diameter of the fuel accumulator line increases. In this way a structure tension is generated in the area of compression that leads to an improved compressive strength thus increasing the material thickness in the vicinity of the connecting area. The thicker the material, the higher the compressive strength. The increased compressive strength is indeed again somewhat reduced by making a hole, but is all in all still big enough to maintain the required high pressure areas without being damaged.

BRIEF DESCRIPTION OF THE DRAWINGS

The invention is explained in greater detail below on the basis of the accompanying drawings as follows.

DETAILED DESCRIPTION OF THE PREFERRED EMBODIMENTS OF THE INVENTION

The invention explained below is based on the embodiment of a fuel accumulator line for an internal-combustion engine, particularly for a diesel operated or petrol operated internal-combustion engine. However, the invention is not limited to this embodiment, but can be used for any type of high-pressure line to which lines must be connected.

Figure 1:
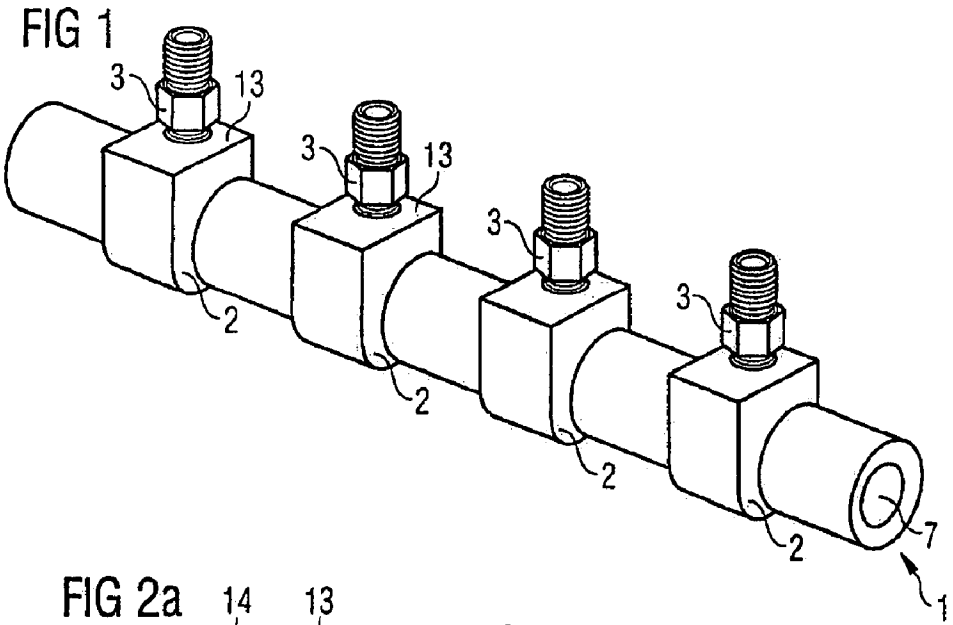
FIG. 1 a perspective representation of a fuel accumulator line with connecting areas, FIG. 2 a cross-section through the fuel accumulator line in the connecting area, FIG. 3 a cross-section through a further embodiment of a connecting area, FIG. 4 a third embodiment of a connecting area of a fuel accumulator line, and FIG. 5 a cross-section through a fuel accumulator line with connecting areas that have different outside diameters.

FIG. 1 is a perspective representation of a fuel accumulator line for an internal combustion engine. In this embodiment, the fuel accumulator line 1 has a hollow cylindrical shape of which the one end area is closed and the second end area is embodied for connecting a supply line. The supply line is connected to a fuel pump that conveys fuel from a tank to the fuel accumulator line. The customary pressure area for direct fuel injection in both petrol internal-combustion engines is in the range between 100 and 150 bar and for diesel internal-combustion engines around 1500 bar. The hollow cylindrical shape of the fuel accumulator line 1 is made, for example, by producing a single pipe and a subsequent hollow space made in the single pipe by a longitudinal bore. This embodiment offers the advantage that the one end of the hollow pipe is connected in one piece to the wall of the hollow pipe. Therefore, a corresponding high-pressure seal need not be provided. A fuel accumulator line 1 has several connecting areas 5 to which lines 6 are connected. In the example of the internal-combustion engines, the lines 6 are connected to injection valves that inject the fuel supplied from the fuel accumulator line into the internal-combustion engine via line 6. In the vicinity of a connecting area 5 there is a connecting piece 2 that is circular and surrounds the fuel accumulator line 1. In the embodiment shown, a connection screw 3 is screwed onto the connecting piece 2. The connecting pieces 2 are mounted onto the fuel accumulator line 1 in such a way that the connecting pieces 2 exert a prestress in the direction of the wall of the fuel accumulator line 1.

Therefore, the prestress for example is generated by means of the fact that before mounting, the outside diameter of the connecting area 5 exceeds the inside diameter of the connecting piece 2. In order that the connecting piece 2 can be mounted onto the connecting area 5, either the inside diameter of the connecting piece 2 is expanded and/or the outside diameter of the connecting area 5 is reduced. The inside diameter of the connecting piece 2 is for example expanded by a temperature increase of the connecting piece 2. Usually, the connecting piece 2 is made of a metallic material that expands at increasing temperatures. Expanding also increases the inside diameter of the connecting piece 2. The outside diameter of the fuel accumulator line 1 contracts in the vicinity of the connecting area 5 due to the fact that the fuel accumulator line 5 that is usually made of a metallic material cools down to a temperature lower than that of the ambient temperature. The cooling down thus contracts the metallic material and the outside diameter of the fuel accumulator line reduces.

The expansion and/or contraction is carried out until the connecting piece 2 can be slid over the connecting area 5. After the connecting piece 2 has been arranged in the connecting area 5, the connecting piece 2 and/or the connecting area 5 is again brought back to the ambient temperature. Therefore, the inside diameter of the connecting piece 2 reduces and/or the outside diameter of the connecting area 5 increases. As a result, the connecting piece 2 has a prestress that acts in a radial direction on the fuel accumulator line 1.

In a further production method, the outside diameter of the connecting area 5 exceeds the inside diameter of the connecting piece 2 by a few percent. By means of lateral crimping, the connecting piece 2 is slid over the connecting area 5. However, on the basis of the mechanical properties of the connecting piece 5, the inside diameter of the connecting piece 5 expands and/or the outside diameter of the fuel accumulator line contracts in which case the yielding point of the material of the connecting piece 2 is preferably not reached. The expansion of the inside diameter of the connecting piece 2 prestresses the connecting piece 2 that acts in a direction on the fuel accumulator line after the end of the crimping process.

Figure 2:
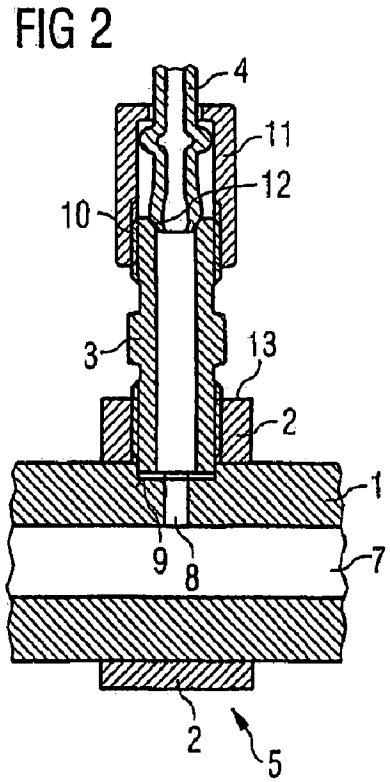

FIG. 2 shows a cross-section through a connecting area 5 of the fuel accumulator line of FIG. 1. In the selected embodiment, the fuel accumulator line 1 is embodied as a hollow cylinder with a hollow volume 7. The wall of the fuel accumulator line 1 has a connecting opening 8 that leads from the hollow volume 7 up to the outside area of the fuel accumulator line 1. In the vicinity of the outside area of the fuel accumulator line 1, the connecting opening 8 expands its cross-section and forms a sealing surface 9 that is embodied in a circular shape in the selected embodiment. On the sealing surface 9 there is a sealing surface allocated to connection screw 3. The connection screw 3 has an outside thread to which the connecting piece 2 with an inside thread is screwed. In the area of the inside thread, the connecting piece 2 is embodied with a thicker material in the direction of the line 4. The thicker material has the advantage that a long inside thread can be embodied. With the long inside thread, the connection screw 3 can be pressed onto the sealing surface 9 with enough force without damaging the inside thread.

The connection screw 3 has a continuous bore that leads to a second end piece 10. At the second end piece 10, the connection screw 3 has an outside thread via which the line 4 can be screwed leak-tight to the connection screw 3 via a cap nut 11. For this the second end piece 10 has a further sealing surface 12 that is embodied conically in this embodiment. Preferably, line 4 also has a conical outside sealing surface at the end to which the second end piece 10 is allocated. By screwing line 4 to the connection screw 3, a leak-tight line connection is established between line 4 and connection screw 3. The connection screw 2 preferably has a plane surface that is placed perpendicular to the longitudinal direction of connection screw 3.

Figure 2B:
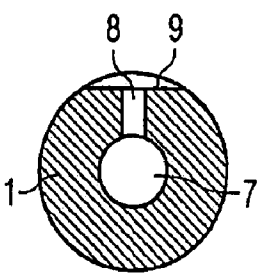
Figure 2A:
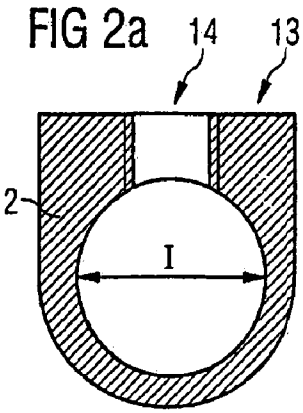

FIG. 2A is a cross-section through a connecting piece 2. Here, the circular inside diameter I that surrounds the connecting piece 2 can clearly be identified. At the same time the plane surface 13 that is arranged in the area of a connecting opening 14 through which the connection screw 3 is led in the mounted state can be identified.

FIG. 2B is a cross-section through the fuel accumulator line 1 in the area of the connecting bore 8.

Figure 3:
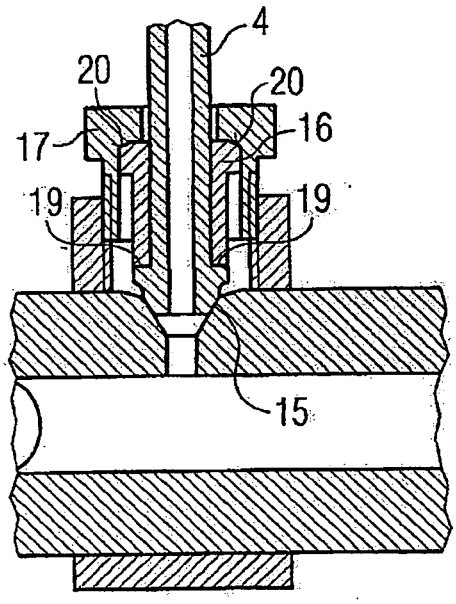

FIG. 3 is a further embodiment of a fuel accumulator line 1 in the case of which the connecting opening 8 has a conical third sealing surface 15 in the end area. In this embodiment, the line 4 leads directly up to the third conical sealing surface 15. In this embodiment, for an optimum sealing the line 4 in the end area that is allocated to the fuel accumulator line 1 also has a conical outside sealing surface. The line 4 is screwed to the connecting piece 2 via an adjusting sleeve 16 and a second cap nut 17. The second cap nut 17 has an outside thread that is screwed to the inside thread of connecting piece 2. The adjusting screw 16 rests with a bottom edge area on a flank 19 of line 4. An upper edge area of the adjusting sleeve 16 rests on the contact surfaces 20 of the second cap nut 17. Therefore, the second cap nut 17 prestresses the line 4 against the third sealing surface 15. Also in this embodiment, the second connecting piece 2 is connected with a prestress to the fuel accumulator line 1.

Figure 4:
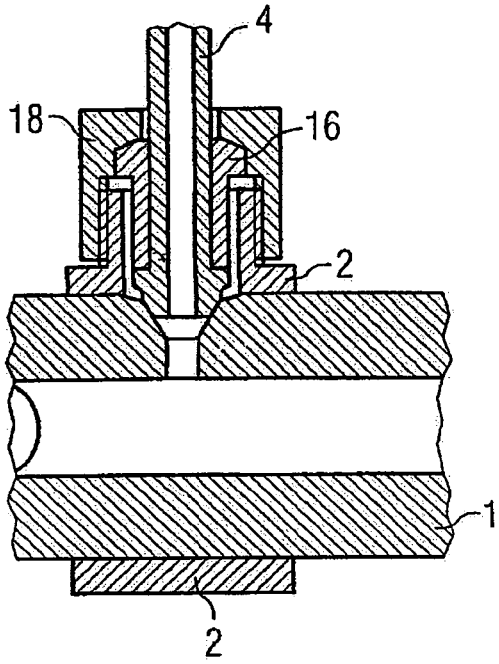

FIG. 4 shows a further embodiment for connecting a line 4 to a fuel accumulator line 1 in which case in this embodiment the prestressed connecting piece 2 has an outside thread and a third cap nut 18 is provided that is screwed to the second connecting piece 2 via an inside thread. An adjusting sleeve 16 is also provided in this embodiment in order to reach an optimum force introduction onto the line 4.

Figure 5:
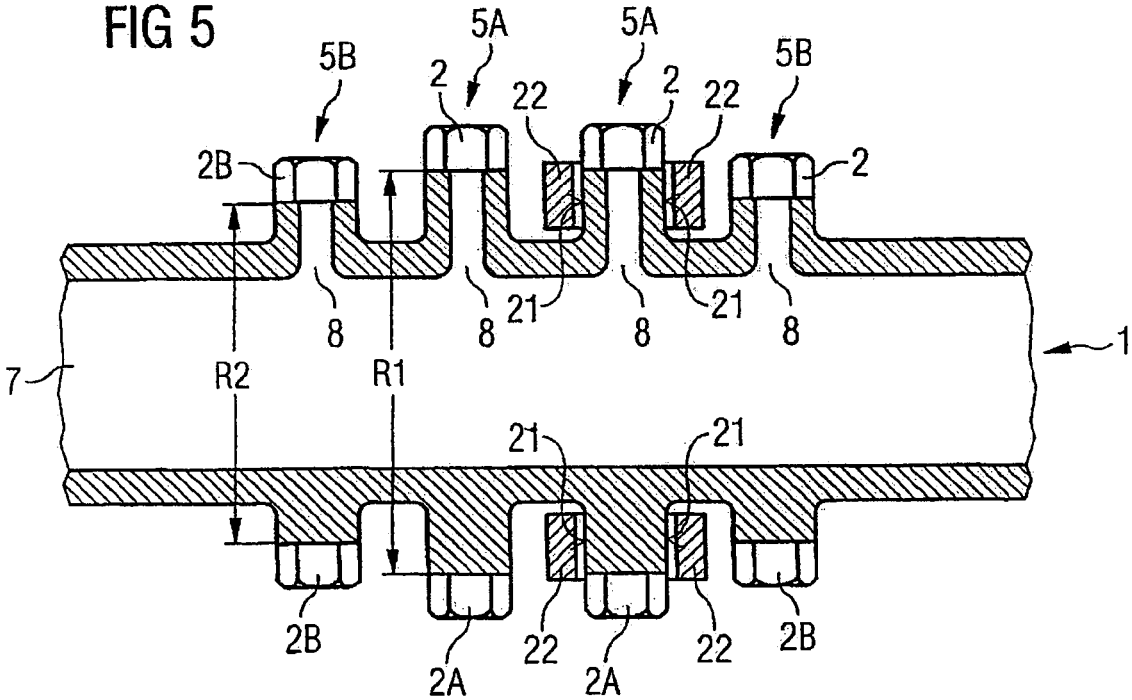

FIG. 5 shows a further preferred embodiment of a fuel accumulator line 1 that has connecting areas 5 with different outside diameters. Four connecting openings 8 are provided in the shown embodiment. The connecting areas 5 are subdivided into two inner connecting areas 5A and two outer connecting areas 5B. The inner connecting areas 5A have a first outside diameter R1 and the outer connecting areas 5B a second outside diameter R2. The first outside diameter R1 exceeds the second outside diameter R2. First connecting pieces 2A are mounted onto the inner connecting areas 5A whose inside diameter is adapted to the outside diameter of the inner connecting areas 5A in such a way that the first connecting pieces 2A slide laterally over the inner connecting areas 5A by crimping and then rest with a prestress on the inner connecting areas 5A after crimping.

Second connecting pieces 2B are allocated to the outer connecting areas 5B whose inside diameters are adapted to the outside diameters of the outer connecting areas 5B in such a way that the connecting pieces 2 can be slid over from the outside over the outer connecting areas 5B by lateral crimping and after the crimping, rest with a prestress on the outer connecting areas 5B. The inside diameters of the first connecting pieces 2A are embodied in such a way that the first connecting pieces 2A can be slid over the outer connecting area 5B to the inner connecting area 5A without crimping. Should there be more than two connecting areas, it is also possible to mount connecting pieces with a prestress to inner connecting areas by simply using a crimping process. In this embodiment a lateral expansion and/or lateral contraction of the connecting piece 2 or the connecting area 5 is not required. Therefore, the embodiment of the fuel accumulator line 1 and the connecting pieces 2 is not limited to materials that can be expanded or contracted laterally. In this way, disadvantages caused by an expansion and/or contraction are avoided.

However, the embodiment in FIG. 5 shows four connections in which case several connections can also be shown by a corresponding adaptation of the outside diameters to the connecting areas 5 or the inside diameters to the connecting pieces 2.

In a further production method, the connecting pieces and the connecting areas have almost an equal inside or outside diameter. In this way, connecting pieces can be slid over the connecting areas without any problems. Subsequently, the outside diameter of the connecting areas increases by compressing. As a result, a prestress that acts on the fuel accumulator line is generated in the connecting piece. For example, a compression is generated because the connecting areas have a gradually increasing diameter compared to the fuel accumulator line (FIG. 5). Two tools 22 can grip the stepped side surfaces 21 that compress the connecting area.

What is claimed:

1. A method for producing a fuel accumulator line for an internal-combustion engine, said method comprising the steps of:

providing a fuel accumulator line with a connecting area including a connecting opening, mounting a connecting piece onto the connecting area with prestress, wherein the inside diameter of the connecting piece is less than the outside diameter of the connecting area, and wherein the mounting comprises reducing the outside diameter of the connecting area.

2. A method according to claim 1, wherein the connecting opening is only made after the connecting piece has been mounted onto the fuel accumulator line.

3. A method according to claim 1, wherein at the area of the connecting opening, a sealing surface is located at the wall of the fuel accumulator line for connecting a line.

4. A fuel accumulator line assembly comprising:

a fuel accumulator line having a connecting area including a connecting opening, a connecting piece for connecting a line to the connecting area, wherein the connecting piece has an inside diameter at ambient temperature which is less than the outside diameter of the connecting area at ambient temperature such that when assembled a prestress is created in the direction of the fuel accumulator line, and another connecting area having an outside diameter different from the connecting area.

5. A fuel accumulator line according to claim 4, wherein the connecting piece also has a connecting opening and the connecting openings of the piece and the accumulator line were made at the same time.

6. A fuel accumulator line according to claim 4, wherein the connecting area comprises a compressed thickening.

7. A method for producing a fuel accumulator line for an internal-combustion engine, said method comprising:

making at least one hole in the wall of the fuel accumulator line in a connecting area, mounting connecting pieces onto connecting areas with prestress, wherein at least two connecting pieces are pressed onto two connecting areas, that the inside diameters of the two connecting pieces differ in size, that the outside diameters of the two connecting areas differ in size, that the inside diameter of a second connecting piece is less than the outside diameter of the allocated inner connecting area, that the inside diameter of the first connecting piece exceeds the outside diameter of the outer connecting area, and that the two connecting pieces are pressed onto the allocated connecting areas via a lateral pressing-on process.

8. A method according to claim 1, wherein the ambient temperature of the connecting piece is increased before mounting to increase the inside diameter.

9. A method according to claim 1, wherein the ambient temperature of the fuel accumulator line is decreased before mounting to decrease the outside diameter.

* * * * *